US005332196A

United States Patent [19]

Wright

[11] Patent Number: 5,332,196

[45] Date of Patent: Jul. 26, 1994

[54] FENCE POST END CAP

[76] Inventor: Richard P. Wright, 311 Cumberland Cove Rd., Monterey, Tenn. 38574

[21] Appl. No.: 999,285

[22] Filed: Dec. 30, 1992

[51] Int. Cl.[5] ..... E04H 17/00

[52] U.S. Cl. ..... 256/47; 256/1; 256/21; 256/DIG. 5; 116/173; 248/523

[58] Field of Search ..... 256/47, 1, 21, 22, DIG. 5; 5/281; 52/301; 116/173; 248/523, 539; 40/607

[56] References Cited

U.S. PATENT DOCUMENTS

| | | | |
|---|---|---|---|
| 1,292,137 | 1/1919 | Strout | 40/607 |
| 1,851,404 | 3/1932 | Rose . | |
| 1,902,511 | 3/1933 | McDaniel | 40/607 |
| 2,249,381 | 7/1941 | Gustafson | 5/281 |
| 3,298,643 | 1/1967 | Taylor | 248/523 |
| 3,643,902 | 2/1972 | Gualano | 116/173 |
| 3,935,655 | 2/1976 | Fritzinger | 40/607 |

FOREIGN PATENT DOCUMENTS

| | | | |
|---|---|---|---|
| 12676 | of 1885 | United Kingdom | 5/281 |
| 8747 | of 1911 | United Kingdom | 5/281 |

*Primary Examiner*—Randolph A. Reese
*Assistant Examiner*—Anthony Knight
*Attorney, Agent, or Firm*—Woodard, Emhardt, Naughton, Moriarty & McNett

[57] ABSTRACT

A fence post end cap is attached to the top of a hollow cylindrical fence post. The end cap has a plurality of different-sized bores which are capable of supporting lawn decorations or accessory items. The items that can be supported by the end cap include but are not limited to a flagpole, a birdhouse, a planter, or even a hook for a coiled garden hose.

10 Claims, 8 Drawing Sheets

FENCE POST END CAP

BACKGROUND OF THE INVENTION

This invention relates generally to an end cap for hollow fence posts, and in particular to an end cap having the ability to support various decorative lawn items.

Metal fencing is used throughout the country to enclose yards, parking lots, businesses or otherwise to prevent intrusion into an area or mark a boundary. Residential fencing is usually on the order of 3-6 feet high, but commerical fencing can be much taller. Regardless of height, the fencing typically includes several spaced apart hollow cylindrical fence posts separated by heavy gauge woven wire fencing arranged in a diamond pattern. Each fence post is typically topped by a bulbous end cap of the type illustrated for instance in U.S. Pat. No. 1,851,404 to Rose. While such end caps can give a fence a minimum of aesthetic value, what is needed is a fence post end cap which gives the fence owner the ability to spruce up the appearance of the fence without otherwise affecting the structural characteristics of the fence.

SUMMARY OF THE INVENTION

One embodiment of the present invention might include a fence post end cap for a hollow fence post. The end cap has a bottom portion that is received into the hollow end of the fence post and secured thereto. A top portion of the end cap is integral with the bottom portion and adapted to extend above the fence post when the bottom portion is secured to the fence post. The end cap has at least one main bore extending through the top portion for receiving an item such as a flagpole to be supported on the end cap. At least one threaded bore is made through the end cap substantially orthogonal to and intersecting the main bore so that a set screw can be threaded into the threaded bore to hold fixed whatever item is received into the main bore.

Another embodiment of the present invention is virtually identical to the embodiment just described except that it includes a rod having a threaded end extending above the top portion of the end cap. A nut is receivable on the threaded end and enables an item such as a planter to be secured to and supported by the fence post end cap.

One object of the present invention is to provide an improved fence post end cap.

Other objects and advantages of the present invention will be apparent from the following description.

DESCRIPTION OF THE PREFERRED EMBODIMENT

Figure 1:
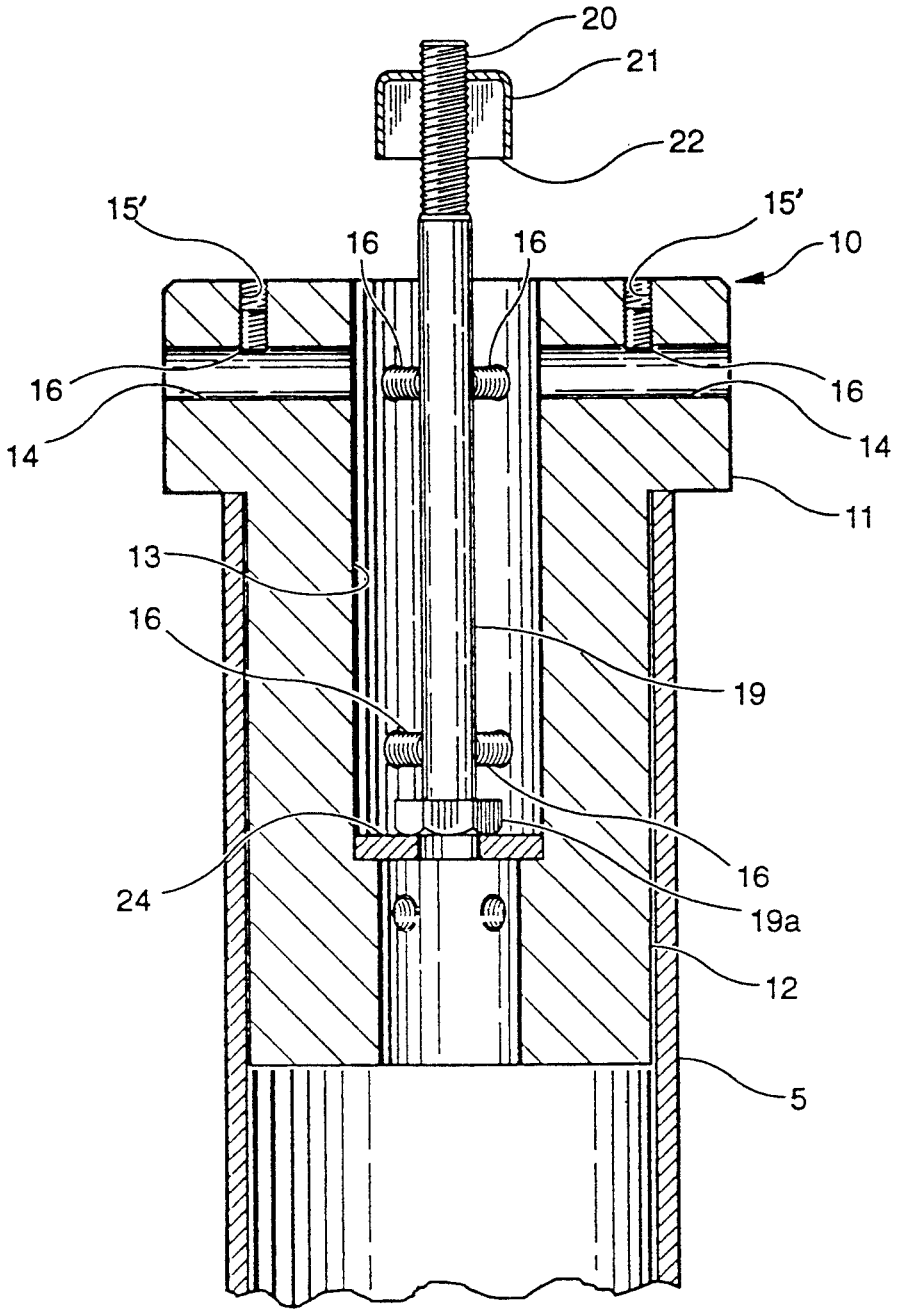
FIG. 1 is a partial sectioned side elevational view of a fence post supporting an end cap according to one embodiment of the present invention, and viewed along section line 1—1 of FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
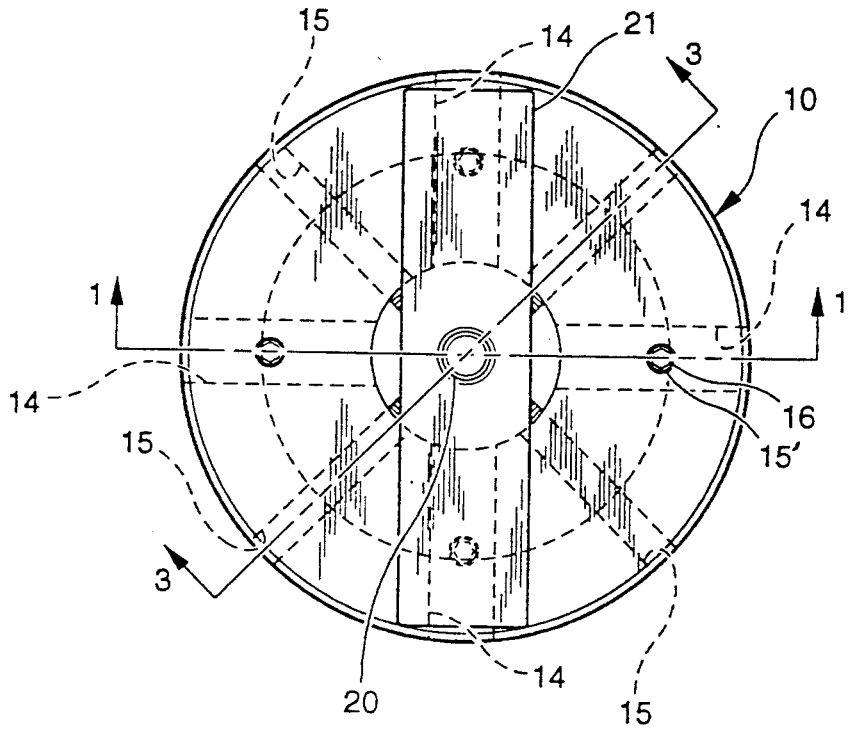
FIG. 2 is a top view of a fence post end cap according to the present invention.
Figure 3:
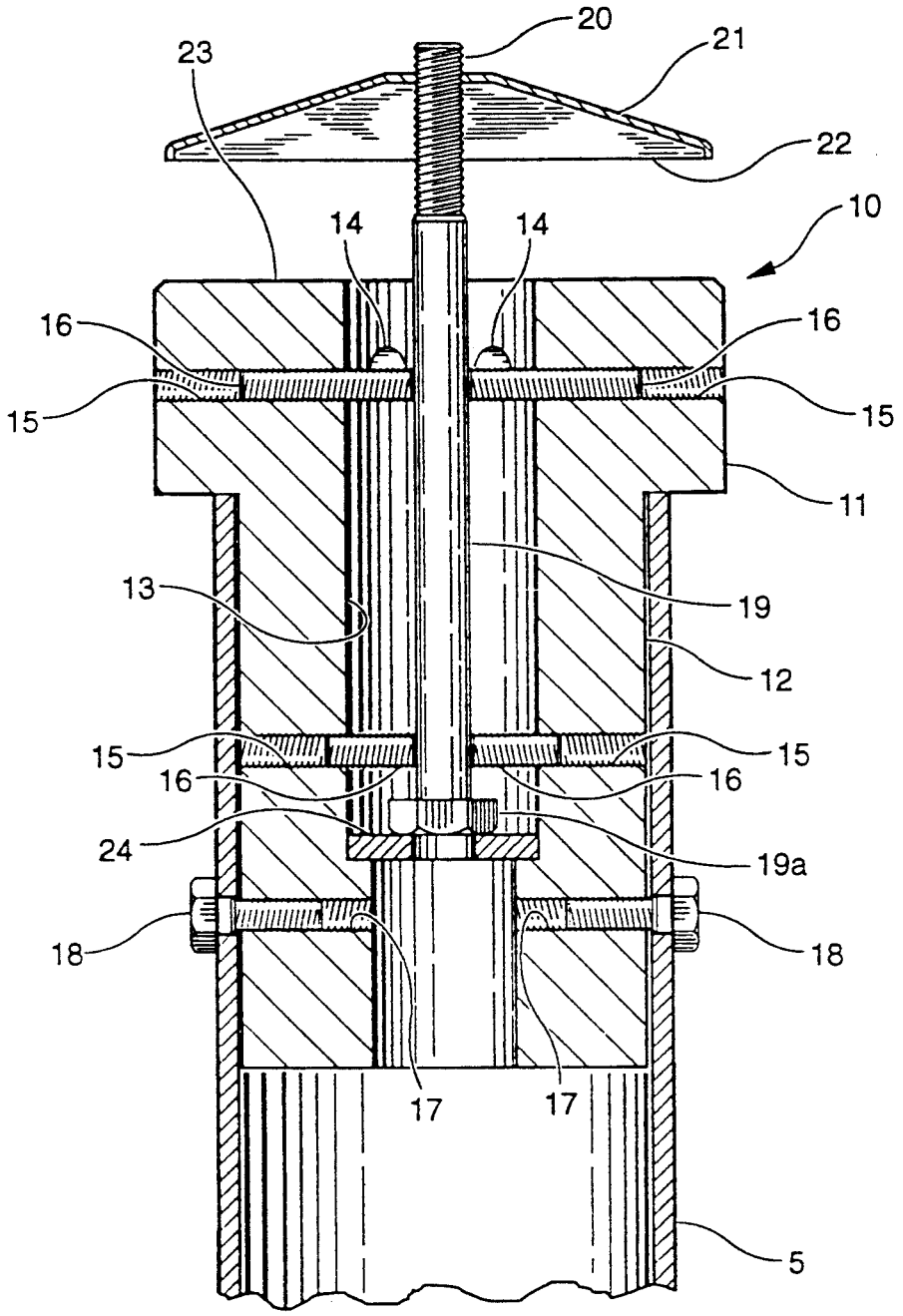
FIG. 3 is a partial sectioned side elevational view of the fence post and end cap of FIGS. 1 and 2 viewed along section line 3—3 of FIG. 2.

Referring now to FIGS. 1-3, the shape and structure of a fence post end cap 10 according to the preferred embodiment of the present invention is illustrated. End cap 10 is shown mounted atop a typical fence post 5 for Cyclone® fencing. Fence post 5 is cylindrical with a hollow inner diameter on the order of $2\frac{1}{4}$ inches. End cap 10 is machined from a single piece of aluminium to have a stepped cylindrical outer surface that includes top portion 11 and bottom portion 12. However, end cap 10 could be made from any suitable material including but not limited to plastic, steel, or even cast iron. Top portion 11 has a diameter larger than the inner diameter of fence post 5, but bottom portion 12 has a diameter just less than that of the fence post. In this way, bottom portion 12 is slidably received into the end of fence post 5, and top portion 11 extends above the top of the fence post. Bottom portion 12 can be secured to fence post 5 through either a friction fit or by providing bottom portion 12 with at least one threaded bore, such as threaded bores 17 (FIG. 3) so that bolts 18 threaded through the wall of fence post 5 can hold end cap 10 in place.

Figure 5:
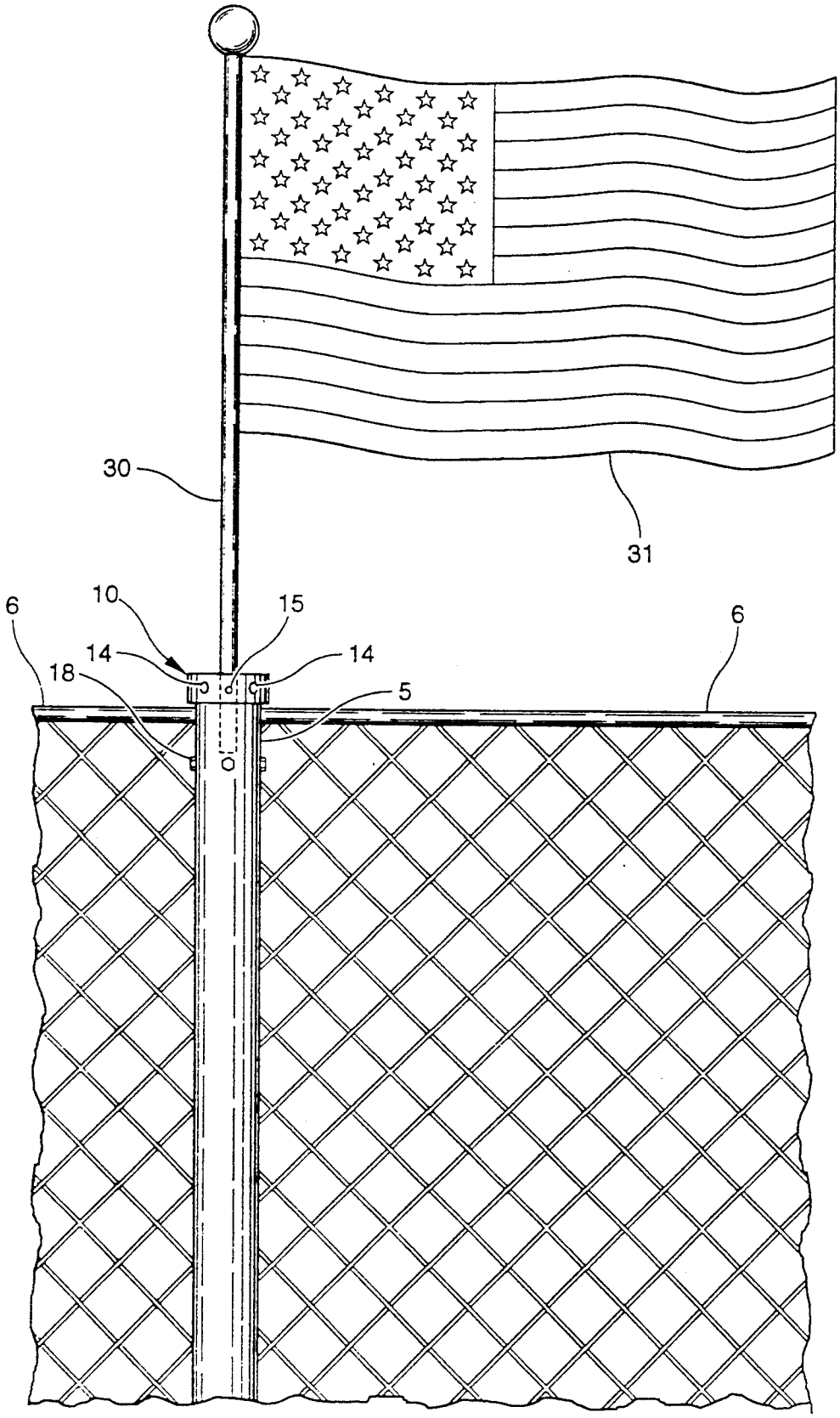
FIG. 5 is a partial side elevational view of a fence having an end cap according to the present invention supporting a flag.
Figure 6:
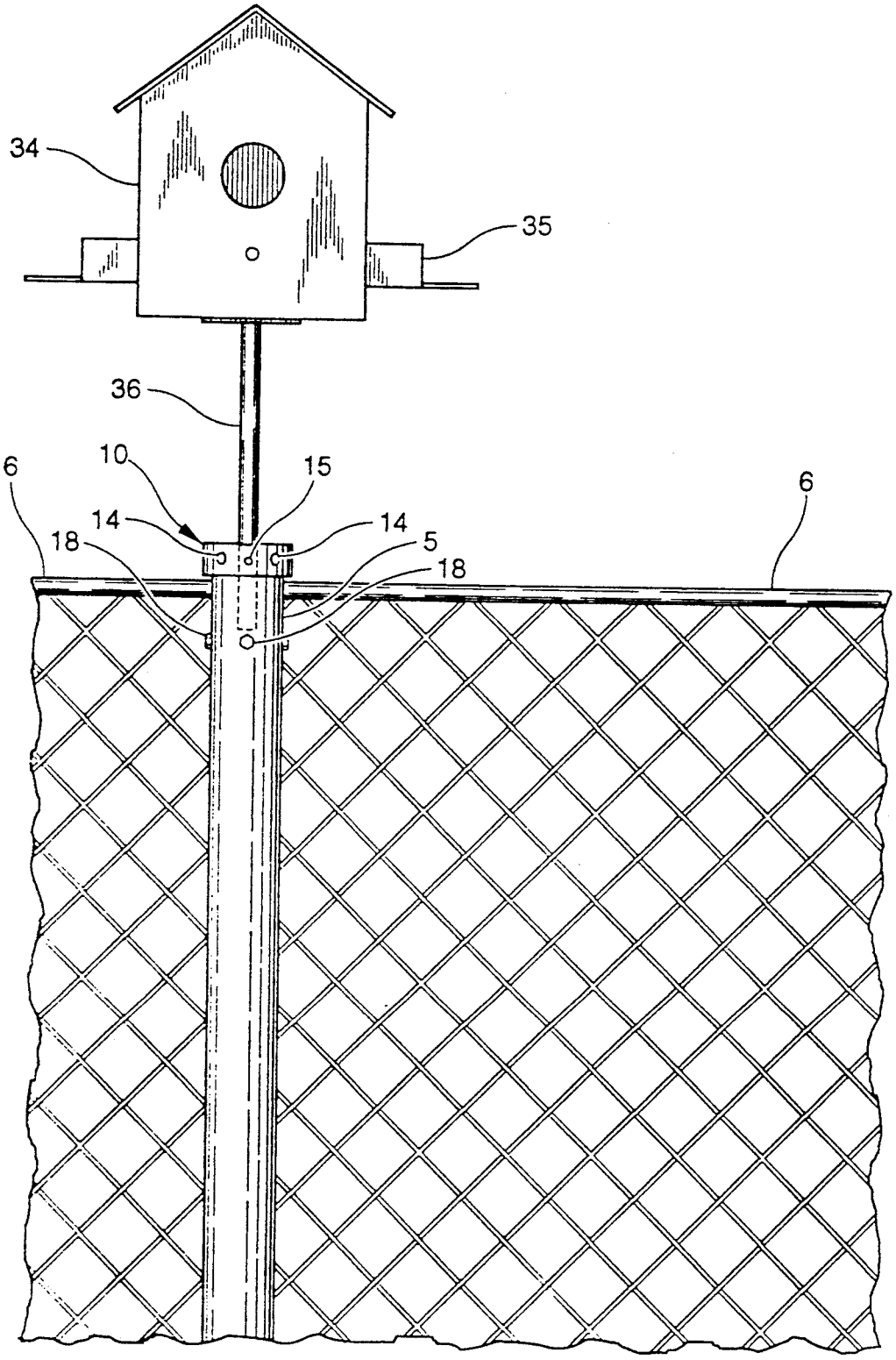
FIG. 6 is a partial side elevational view of a fence having a end cap according to the present invention supporting a birdhouse/feeder.

End cap 10 includes a vertical main bore 13 on the order of 1 inch in diameter for receiving items such as a flagpole (FIG. 5) or a support pole for a birdhouse (FIG. 6). Main bore 13 is stepped in order to provide an annular support surface upon which an item such as the base of flagpole 30 can be supported. With regard to FIGS. 1 and 3, the stepped portion of main bore 13 supports a washer 24 which in turn supports the head 19*a* of bolt 19. A pair of mutually orthogonal threaded bores 15 extend horizontally through top portion 11 and intersect main bore 13. Likewise, a pair of mutually orthogonal threaded bores 15 extend horizontally through bottom portion 12. Each of the threaded bores 15 opens into and intersects main bore 13, and each includes a set screw 16 that may be advanced into main bore 13 to grip an item to be supported in main bore 13, such as bolt 19 shown in FIGS. 1 and 3. Washer 24 prevents bolt 19 from falling into fence post 5 should one or more of the set screws 16 become loose. Bolt 19 includes a threaded end 20 that extends above top portion 11 so that an item such as a planter (FIG. 7) can be secured atop end cap 10. Bolt 19 is secured within main bore 13 by a plurality of set screws 16 such that its threaded end 20 extends above top portion 11. A nut 21 having an enlarged gripping surface 22 is received on threaded end 20 and is capable of securing an item to horizontal support surface 23 of top portion 11.

Figure 7:
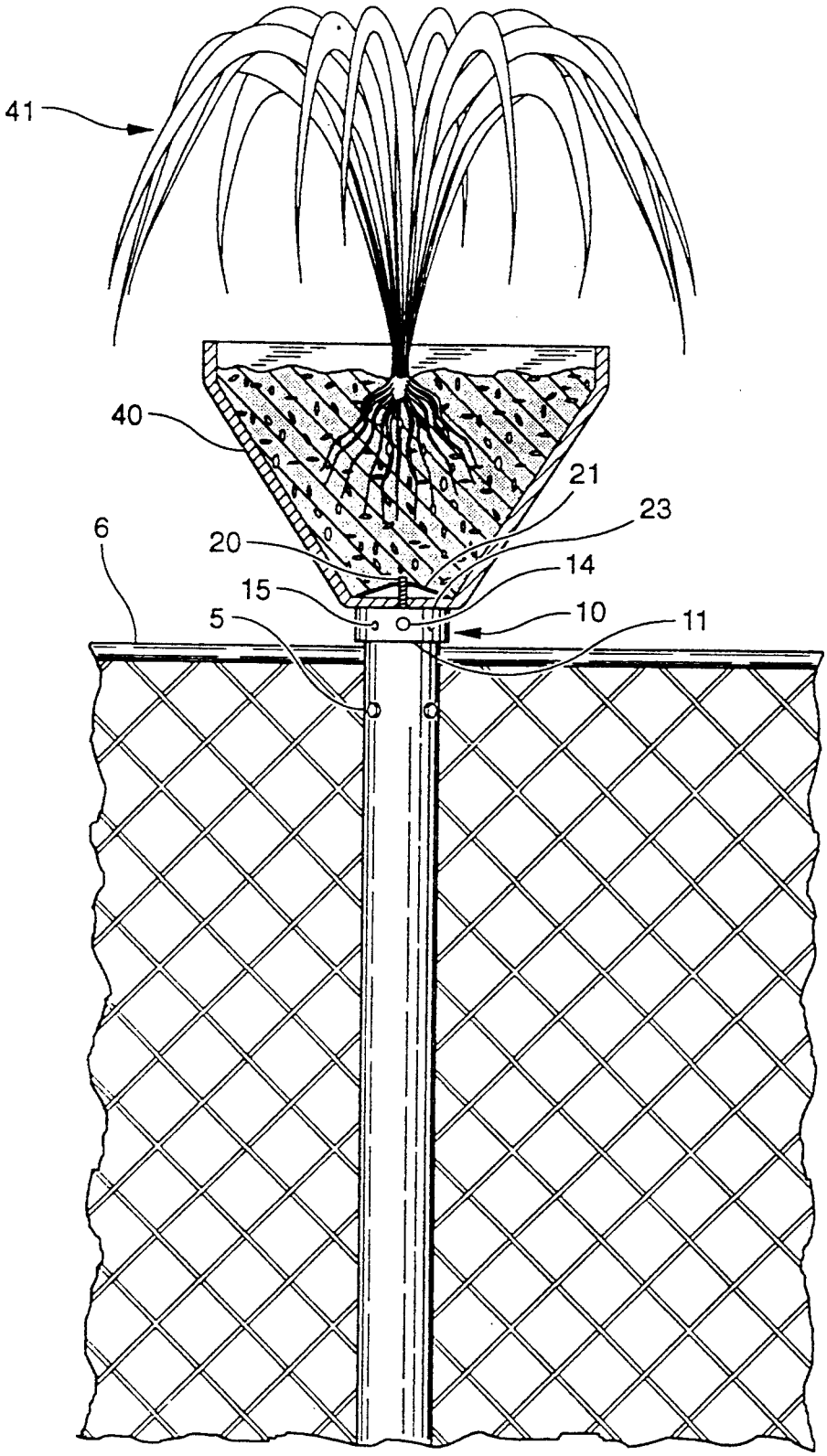
FIG. 7 is a partial side elevational view of a fence having an end cap according to the present invention supporting a planter thereon.

By securing bolt 19 in end cap 10 as shown in FIGS. 1 and 3, one is able to support an item such as a planter 40 having a plant 41 therein as shown in FIG. 7. In this case, planter 40 includes a bore through its bottom that receives threaded end 20 therethrough. The planter is then secured to top horizontal surface 23 of end cap 10 by nut 21. When end cap 10 is used to support a pole, such as flagpole 30 of FIG. 5 or support pole 36 of FIG. 6, bolt 19 is not utilized. Instead, flagpole 30 holding flag 31 or support pole 36 supporting bird house 34/feeder 35 is simply received in main bore 13 and then secured in place utilizing set screws 16. If necessary, the radius of the pole received in main bore 13 can be stepped up utilizing segments of plastic and/or copper tubing. Thus, a rod or pole having virtually any diameter could be supported vertically in main bore 13 utilizing the stepped portion of the bore and set screws 16 with or without auxiliary sleeves as necessary.

Figure 4:
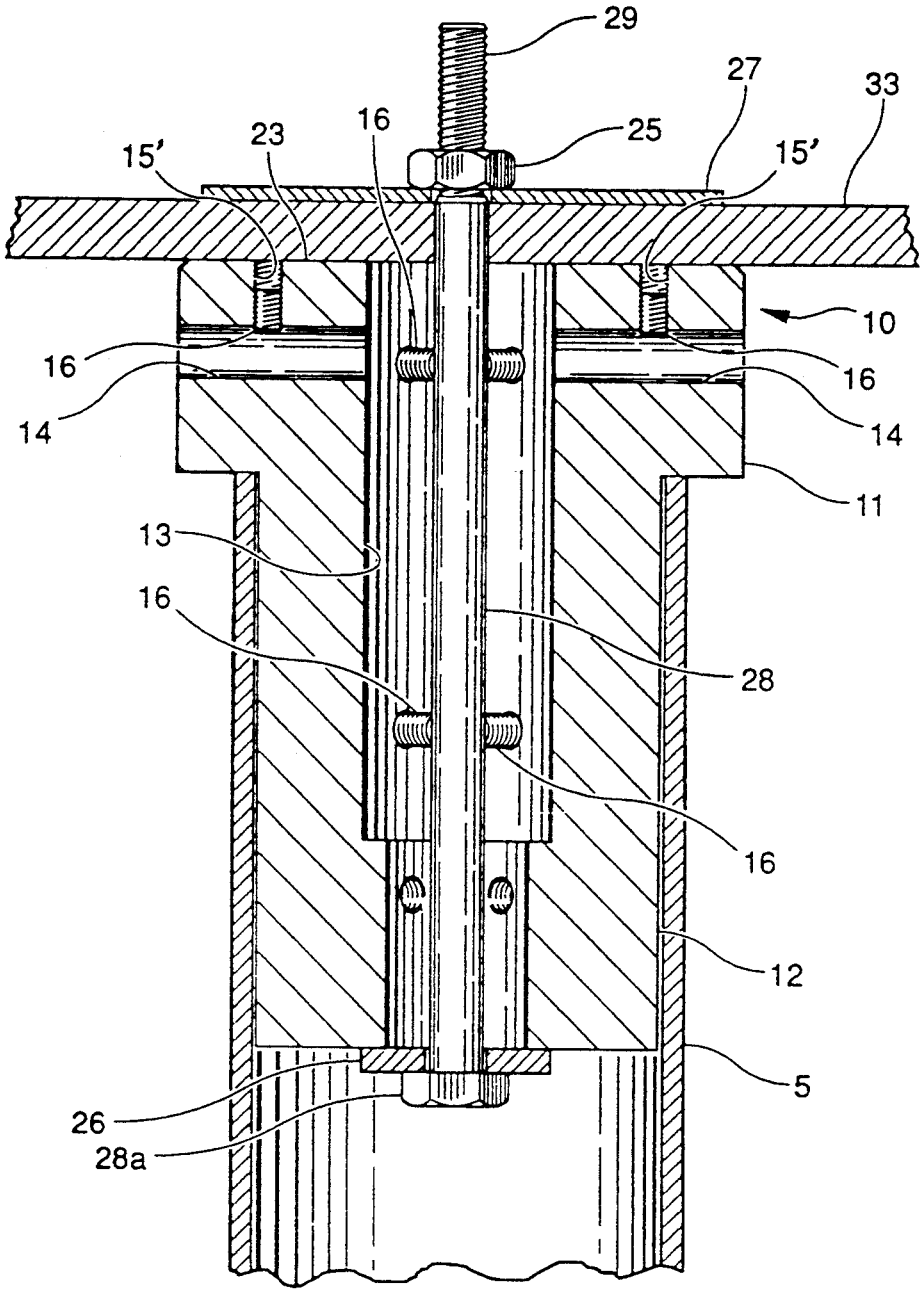
FIG. 4 is a partial sectioned side elevational view analagous to FIG. 1 except utilizing a longer bolt.

FIG. 4 illustrates an embodiment of the present invention that is virtually identical to the embodiment shown in FIGS. 1–3 except that the embodiment of FIG. 4 includes a longer bolt 28. In this case, bolt 28 is longer than end cap 10 so that its head portion 28*a* extends below the bottom of the end cap. An elongated bolt allows an item to be attached to end cap 10 before being mounted atop fence post 5. A portion of a decorative lawn item 33 is shown attached adjacent top surface 23 by bolt 28. Enlarged washer or plate 27 in effect gives ordinary nut 25 an enlarged gripping surface in order to ensure the stability of item 33 after being mounted atop fence post 5. Washer 26 prevents head 28*a* of bolt 28 from being pulled into main bore 13 when item 33 is fastened to end cap 10. In this variation of the present invention, the decorative lawn item is attached to end cap 10, which combination is then mounted atop fence post 5 as previously described.

Figure 8:
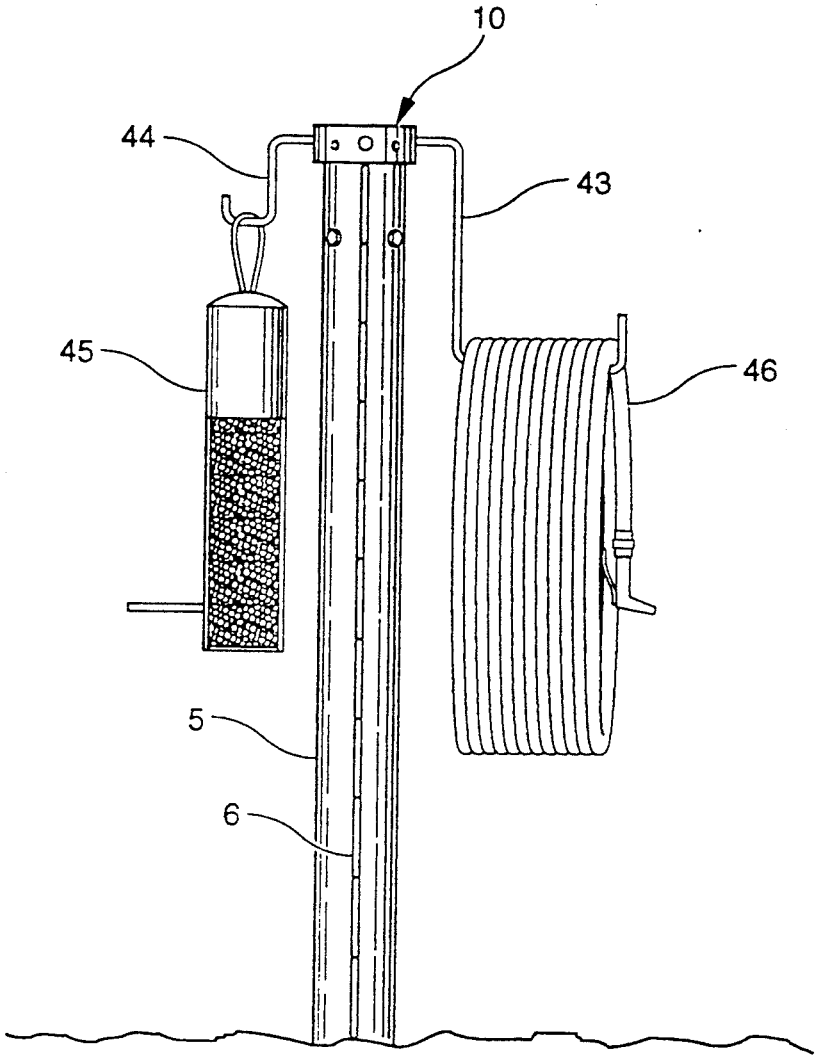
FIG. 8 is an end elevational view of a fence having an end cap according to the present invention supporting a pair of hooks upon which are hung a hummingbird feeder and a coiled garden hose.

Referring back to FIG. 1, top portion 11 of end cap 10 includes a pair of mutually orthogonal 5/16 inch bores 14 that extend horizontally through top portion 11. A vertical threaded bore 15' extends into each bore 14 on either side of main bore 13 as shown in FIG. 1. Each threaded bore 15' includes a set screw 16 that may be advanced into a portion of one of the bores 14. Bores 14 are generally sized to receive ¼ inch diameter iron rods that are bent into a decorative shaped hook or other shape as desired. Referring to FIG. 8, two different hooks, 43 and 44, are shown secured to an end cap 10. Hooks 43 and 44 simply have one end inserted into a bore 14 and are secured thereto by a set screw 16. In this case, hook 43 is shaped to hold a coiled garden hose 46 while hook 44 is shaped to support a smaller item such as a hummingbird feeder 45 as shown.

Although not illustrated, there other ways in which a decorative lawn item could be attached to the fence post end cap of the present invention. For instance, an item could be directly bolted to the top of fence post end cap 10 by utilizing an appropriately sized threaded bolt with vertical set screw holes 15' (see FIG. 2.). Of course, set screws 16 would likely have to be removed in order to exploit this alternative method of attaching an item to fence post end cap 10. Other alternative mounting means also exists, and one of the more important aspects of the present invention is its flexibility to support virtually any decorative lawn item on top of end cap 10.

While the invention has been illustrated and described in detail in the drawings and foregoing description, the same is to be considered as illustrative and not restrictive in character. For instance, fence posts come in a myriad of different diameters, and while the present invention has been described with respect to an ordinary 2½ inch fence post, the dimensions of the present invention can be scaled up or down accordingly to accommodate whatever size fence post is to be utilized. Furthermore, main bore 13 and mounting side bores 14 could be scaled up or down accordingly with the size of the end cap to suit any particular application. Finally, the present invention has been described with respect to a circular fence post but could equally well be adapted for fence posts having different shaped cross sections such as square or triangular, in which case, base portion 12 of end cap 10 would be shaped accordingly. It is to be understood that only the preferred embodiment has been shown and described and that all changes and modifications that come within the spirit of the invention are desired to be protected.

What is claimed is:

1. A fence post end cap for a hollow fence post, comprising:

a bottom portion sized to be received in the fence post;

means for securing said bottom portion to the fence post;

a top portion integral with said bottom portion and adapted to extend above the fence post when said bottom portion is secured to the fence post;

said end cap having a main bore extending through said top portion;

at least one threaded bore through said end cap substantially orthogonal to and intersecting said main bore; and a set screw in each said threaded bore capable of extending into said main bore.

2. The fence post end cap of claim 1 wherein said main bore is about one inch in diameter and extends vertically when said bottom portion is secured to the fence post.

3. The fence post cap of claim 2 wherein said top portion includes at least one side bore into said top portion extending substantially horizontal when said bottom portion is secured to the fence post;

at least one threaded bore into said top portion substantially orthogonal and intersecting said at least one side bore; and a set screw in each said threaded bore capable of extending into one of said at least one side bore.

4. A fence post end cap for a hollow fence post, comprising:

a bottom portion sized to be received in the fence post;

means for securing said bottom portion to the fence post;

a top portion integral with said bottom portion and adapted to extend above the fence post when said bottom portion is secured to the fence post and having a main bore;

a rod having a threaded end extending through said main bore vertically above said top portion;

means for attaching said rod to said end cap, said means including:

at least one threaded bore through said end cap substantially orthogonal to and intersecting said main bore;

a set screw in each said at least one threaded bore capable of extending into said main bore and additionally capable of contacting said rod; and a nut receivable on said threaded end.

5. The fence post end cap of claim 4 wherein said top portion has an upper supporting surface that is substantially horizontal when said bottom portion is secured to the fence post.

6. A fence post end cap for a hollow fence post, comprising:

a bottom portion sized to be received in the fence post;

means for securing said bottom portion to the fence post;

a top portion integral with said bottom portion and adapted to extend above the fence post when said bottom portion is secured to the fence post and having a main bore, wherein said top portion includes:

an upper supporting surface that is substantially horizontal when said bottom portion is secured to the fence post;

at least one side bore extending substantially horizontal when said bottom portion is secured to the fence post;

at least one threaded bore into said top portion substantially orthogonal and intersecting said at least one side bore; and a set screw in each said threaded bore capable of extending into one of said at least one side bore; and a rod having a threaded end extending through said main bore vertically above said top portion;

means for attaching said rod to said end cap; and a nut receivable on said threaded end.

7. The fence post end cap of claim 6 wherein said nut includes an enlarged gripping surface.

8. A fence post end cap for a hollow fence post, comprising:

a bottom portion sized to be received in the fence post;

means for securing said bottom portion to the fence post;

a top portion integral with said bottom portion and adapted to extend above the fence post when said bottom portion is secured to the fence post;

said top portion including at least one side bore extending substantially horizontal when said bottom portion is secured to the fence post;

at least one threaded bore into said top portion substantially orthogonal to and intersecting said at least one side bore; and a set screw in each said threaded bore capable of extending into one of said at least one side bore.

9. The fence post end cap of claim 8 further including a main bore extending through said top portion;

at least one threaded bore through said end cap substantially orthogonal to and intersecting said main bore; and a set screw in each said threaded bore capable of extending into said main bore.

10. The fence post end cap of claim 9 wherein said main bore is about one inch in diameter and extends vertically when said bottom portion is secured to the fence post.

* * * * *